US008826964B2

(12) United States Patent
Goodman

(10) Patent No.: US 8,826,964 B2
(45) **Date of Patent: *Sep. 9, 2014**

(54) LATERAL RESTRAINT ASSEMBLIES, MOVABLE PARTITIONS INCLUDING LATERAL RESTRAINT DEVICES AND RELATED METHODS

(71) Applicant: Won-Door Corporation, Salt Lake City, UT (US)

(72) Inventor: E. Carl Goodman, Bountiful, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/931,158

(22) Filed: Jun. 28, 2013

(65) Prior Publication Data

US 2013/0284382 A1 Oct. 31, 2013

Related U.S. Application Data

(63) Continuation of application No. 13/333,584, filed on Dec. 21, 2011, now Pat. No. 8,479,798, which is a continuation of application No. 11/951,901, filed on Dec. 6, 2007, now Pat. No. 8,087,444, which is a continuation-in-part of application No. 11/796,325, filed on Apr. 27, 2007, now Pat. No. 7,740,046, and a continuation-in-part of application No. 11/934,566, filed on Nov. 2, 2007, now Pat. No. 7,931,067.

(60) Provisional application No. 60/856,597, filed on Nov. 3, 2006.

(51) Int. Cl.
*E06B 3/48* (2006.01)

(52) U.S. Cl.
USPC ..... 160/199; 160/118

(58) Field of Classification Search
USPC ..... 160/84.01, 84.04, 84.05, 126, 40, 160/196.1, 199, 84.09, 84.1, 342, 123; 104/94
See application file for complete search history.

(56) References Cited

U.S. PATENT DOCUMENTS 684,130 A 10/1901 Taubert
1,205,707 A 11/1916 Cahill (Continued)

FOREIGN PATENT DOCUMENTS

DE 2506469 8/1975
DE 2755157 6/1979

(Continued)

OTHER PUBLICATIONS

PCT International Search Report for Application No. PCT/US2008/061167 dated Oct. 14, 2008.

(Continued)

*Primary Examiner* — Blair M. Johnson
(74) *Attorney, Agent, or Firm* — TraskBritt

(57) ABSTRACT

Embodiments of the present invention include movable partitions and devices, methods and systems that help to limit or prevent lateral displacement of movable partitions. In accordance with one embodiment of the present invention, a movable partition includes two structures, each structure having a first plurality of panels, and each panel being hingedly coupled to an adjacent panel. The two panels are each supported from an overhead track at laterally spaced locations. One or more lateral restraint devices are supported from the overhead track at a location between the two laterally spaced structures. The lateral restraint device may include a trolley disposed in a channel of the overhead track and an elongated member coupled with the trolley and extending away from the trolley to a location proximate a lower edge of the first structure and a lower edge of the second structure.

18 Claims, 7 Drawing Sheets

(56) References Cited

U.S. PATENT DOCUMENTS

| | | | |
|---|---|---|---|
| 1,377,626 | A | 5/1921 | Phillips |
| 1,448,845 | A | 3/1923 | Johnson et al. |
| 1,463,347 | A | 7/1923 | Walker |
| 1,595,669 | A | 8/1926 | Kurner |
| 1,612,443 | A | 12/1926 | Johnson et al. |
| 1,644,285 | A | 10/1927 | Smith |
| 1,786,505 | A | 12/1930 | Phillips |
| 1,833,496 | A | 11/1931 | Phillips |
| 1,964,316 | A | 6/1934 | Ellison |
| 2,027,992 | A | 1/1936 | Maurer |
| 2,043,981 | A | 6/1936 | Bickel |
| 2,151,033 | A | 3/1939 | Jones |
| 2,736,373 | A | 2/1956 | Truesdale |
| 2,915,115 | A | 12/1959 | Reynolds |
| 3,039,554 | A | 6/1962 | Hosking et al. |
| 3,082,817 | A | 3/1963 | Merrill |
| 3,102,581 | A | 9/1963 | Kochanowski |
| 3,133,589 | A | 5/1964 | Harris |
| 3,223,147 | A | 12/1965 | Holloway |
| 3,289,741 | A | 12/1966 | Gossling |
| 3,295,257 | A | 1/1967 | Douglass |
| 3,348,628 | A | 10/1967 | Dixon et al. |
| 3,389,741 | A | 6/1968 | Bean |
| 3,447,584 | A | 6/1969 | Smart |
| 3,453,790 | A | 7/1969 | Harris |
| 3,481,388 | A | 12/1969 | Smart |
| 3,509,934 | A | 5/1970 | Smart |
| 3,577,679 | A | 5/1971 | Petterborg |
| 3,698,036 | A | 10/1972 | Goodman |
| 3,720,254 | A | 3/1973 | Smart |
| 3,850,223 | A | 11/1974 | Tompkins |
| 3,910,338 | A | 10/1975 | Pontoppidan |
| 3,972,381 | A | 8/1976 | Gail |
| 3,979,861 | A | 9/1976 | Fromme et al. |
| 4,014,072 | A | 3/1977 | Schumacher |
| 4,133,364 | A | 1/1979 | Smart |
| 4,154,280 | A | 5/1979 | Hashimoto |
| 4,172,423 | A | 10/1979 | Monne |
| 4,408,369 | A | 10/1983 | Labelle |
| 4,658,878 | A | 4/1987 | Williams |
| 4,763,712 | A | 8/1988 | Van der Klaauw |
| 4,834,161 | A | 5/1989 | Johnson et al. |
| 4,852,628 | A | 8/1989 | Klein |
| 4,867,221 | A | 9/1989 | Dixon et al. |
| 4,887,659 | A | 12/1989 | West |
| 4,922,987 | A | 5/1990 | Marontate et al. |
| 4,924,929 | A | 5/1990 | Johnson et al. |
| 4,932,455 | A | 6/1990 | Yamada |
| 4,957,600 | A | 9/1990 | Carlson et al. |
| 5,025,846 | A | 6/1991 | West |
| 5,065,807 | A | 11/1991 | Maeda et al. |
| 5,143,137 | A | 9/1992 | West |
| 5,287,908 | A | 2/1994 | Hoffmann et al. |
| 5,295,527 | A | 3/1994 | West |
| 5,373,887 | A | 12/1994 | Glover |
| 5,411,072 | A | 5/1995 | Starck et al. |
| 5,456,303 | A | 10/1995 | Horinouchi |
| 5,477,902 | A | 12/1995 | Kraeutler |
| 5,542,460 | A | 8/1996 | McKeon |
| 5,577,348 | A | 11/1996 | Keller |
| 5,638,639 | A | 6/1997 | Goodman et al. |
| 5,749,407 | A | 5/1998 | Brenner et al. |
| 5,828,972 | A | 10/1998 | Asanuma et al. |
| 5,947,178 | A | 9/1999 | Patten |
| 6,035,918 | A | 3/2000 | Kraeutler |
| 6,098,695 | A | 8/2000 | Schwingle |
| 6,145,568 | A | 11/2000 | Lundstrom |
| 6,209,171 | B1 | 4/2001 | Pelletier et al. |
| 6,223,804 | B1 | 5/2001 | Toti |
| 6,267,169 | B1 | 7/2001 | McDonald |
| 6,283,189 | B1 | 9/2001 | Liebscher |
| 6,286,258 | B1 | 9/2001 | Bischof et al. |
| 6,360,518 | B1 | 3/2002 | Scott et al. |
| 6,378,440 | B1 | 4/2002 | Rhodes |
| 6,601,637 | B2 | 8/2003 | Toti |
| 6,615,894 | B1 | 9/2003 | McKeon |
| 6,662,848 | B2 | 12/2003 | Goodman et al. |
| 6,708,094 | B2 | 3/2004 | Charaudeau et al. |
| 6,766,847 | B1 | 7/2004 | Wang |
| 7,050,283 | B2 | 5/2006 | Field et al. |
| 7,066,297 | B2 | 6/2006 | Goodman et al. |
| 7,190,132 | B2 | 3/2007 | Goodman et al. |
| 7,478,663 | B2 | 1/2009 | Goodman |
| 7,513,293 | B2 | 4/2009 | Goodman |
| 7,647,729 | B2 | 1/2010 | Polus |
| 7,656,129 | B2 | 2/2010 | Banta et al. |
| 7,699,089 | B2 | 4/2010 | Knutson et al. |
| 7,737,860 | B2 | 6/2010 | Banta et al. |
| 7,740,046 | B2 | 6/2010 | Goodman et al. |
| 7,782,019 | B2 | 8/2010 | Banta et al. |
| 7,845,384 | B2 | 12/2010 | Goodman et al. |
| 7,845,385 | B2 | 12/2010 | Goodman et al. |
| 7,845,386 | B2 | 12/2010 | Coleman et al. |
| 7,854,248 | B2 | 12/2010 | Coleman et al. |
| 7,874,341 | B2 | 1/2011 | Coleman et al. |
| 7,886,804 | B2 | 2/2011 | Goodman et al. |
| 7,926,538 | B2 | 4/2011 | Coleman et al. |
| 7,931,067 | B2 | 4/2011 | Goodman et al. |
| 8,051,616 | B2 | 11/2011 | George |
| 8,087,444 | B2 | 1/2012 | Goodman |
| 2003/0226645 | A1 | 12/2003 | Toti |
| 2004/0069420 | A1 | 4/2004 | Petriello |
| 2004/0173325 | A1 | 9/2004 | Maas |
| 2006/0144529 | A1 | 7/2006 | Hemphill |
| 2007/0152427 | A1 | 7/2007 | Olsen |
| 2007/0272370 | A1 | 11/2007 | Knutson et al. |
| 2008/0105387 | A1 | 5/2008 | Coleman et al. |
| 2009/0188633 | A1 | 7/2009 | Goodman et al. |
| 2010/0102764 | A1 | 4/2010 | Banta et al. |
| 2010/0214709 | A1 | 8/2010 | Hall et al. |
| 2010/0299871 | A1 | 12/2010 | Kondash et al. |
| 2011/0000625 | A1 | 1/2011 | George |
| 2011/0005689 | A1 | 1/2011 | Coleman et al. |
| 2011/0024061 | A1 | 2/2011 | Bell et al. |
| 2011/0036016 | A1 | 2/2011 | Knight et al. |
| 2011/0036509 | A1 | 2/2011 | Goodman et al. |
| 2011/0036513 | A1 | 2/2011 | Banta et al. |
| 2011/0061820 | A1 | 3/2011 | Coleman et al. |
| 2011/0088322 | A1 | 4/2011 | Coleman et al. |
| 2011/0093095 | A1 | 4/2011 | Goodman et al. |
| 2011/0186249 | A1 | 8/2011 | Coleman et al. |
| 2011/0203746 | A1 | 8/2011 | Smart |
| 2011/0247275 | A1 | 10/2011 | Coleman et al. |
| 2011/0247764 | A1 | 10/2011 | Coleman et al. |

FOREIGN PATENT DOCUMENTS

| | | |
|---|---|---|
| DE | 29506707 | 7/1995 |
| DE | 202005000165 | 3/2006 |
| EP | 0111962 | 6/1984 |
| EP | 1630337 | 1/2006 |
| GB | 1226442 | 3/1971 |
| JP | 07317422 | 5/1995 |
| JP | 07317423 | 5/1995 |
| WO | 2005098189 | 10/2005 |

OTHER PUBLICATIONS

PCT International Search Report Application No. PCT/US2007/083520 dated Mar. 25, 2008.

PCT International Search Report for Application PCT/US2007/083526 dated Oct. 7, 2008.

PCT International Search Report for Application No. PCT/US2008/085504 dated Feb. 24, 2009.

PCT International Search Report and Written Opinion for PCT/2008/050873 dated Oct. 7, 2008.

PCT Written Opinion for Application No. PCT/US2008/061167 dated Oct. 14, 2008.

PCT Written Opinion for Application No. PCT/US2007/083520 dated Mar. 25, 2008.

PCT Written Opinion for Application No. PCT/US2007/083526 dated Oct. 7, 2008.

(56) References Cited

OTHER PUBLICATIONS

PCT Written Opinion for Application No. PCT/US2008/085504 dated Feb. 24, 2009.
PCT International Preliminary Report on Patentability for Application No. PCT/US2008/061167 dated Oct. 27, 2009.
PCT International Preliminary Report on Patentability for Application No. PCT/US2007/083520 dated May 5, 2009.
PCT International Preliminary Report on Patentability for Application No. PCT/US2007/083526 dated May 5, 2009.
PCT International Preliminary Report on Patentability for Application No. PCT/US2008/085504 dated Jun. 8, 2010.
PCT International Preliminary Report on Patentability for Application No. PCT/2008/050873 dated Jul. 14, 2009.
Proprietary Material—Document filed separately by Express Mail on Jan. 29, 2014, pursuant to M.P.E.P. § 724, with Petition under 37 CFR § 1.59.

LATERAL RESTRAINT ASSEMBLIES, MOVABLE PARTITIONS INCLUDING LATERAL RESTRAINT DEVICES AND RELATED METHODS

CROSS-REFERENCE TO RELATED APPLICATIONS

This application is a continuation of U.S. patent application Ser. No. 13/333,584, filed Dec. 21, 2011, now U.S. Pat. No. 8,479,798,issued Jul. 9, 2013, which application is a continuation of U.S. patent application Ser. No. 11/951,901, filed Dec. 6, 2007, now U.S. patent No. 8,087,444, issued Jan. 3, 2012, which is a continuation-in-part of U.S. patent application Ser No. 11/796,325, entitled METHOD, APPARATUS AND SYSTEM FOR CONTROLLING A MOVABLE PARTITION, filed Apr. 27, 2007, now U.S. Pat. No. 7,740,046, issued Jun. 22, 2010, and is a continuation-in-part of U.S. patent application Ser. No. 11/934,566, entitled MOVABLE PARTITIONS WITH LATERAL RESTRAINT DEVICES AND RELATED METHODS, filed Nov. 2, 2007, now U.S. Pat. 7,931,067, issued Apr. 26, 2011, and which claims priority to U.S. Provisional Application No. 60/856,597, entitled MOVABLE PARTITIONS WITH LATERAL RESTRAINT DEVICES AND RELATED METHODS, filed Nov. 3, 2006, the disclosures of each of which are incorporated by reference herein in their entireties.

The subject matter of this application is related to U.S. patent application Ser. No. 13/086,014, filed Apr. 13, 2011, now U.S. Pat. No. 8,235,085, issued Aug. 7, 2012, which is a continuation of U.S. patent application Ser. No. 11/652,446, filed Jan. 11, 2007, now U.S. Pat. No. 7,926,538, issued Apr. 19, 2011; U.S. patent application Ser. No. 12/756,066 filed Apr. 7, 2010, now U.S. Pat. No. 8,448,688, issued May 28, 2013, which is a continuation of U.S. patent application Ser. No. 11/796,325, filed Apr. 27, 2007, now U.S. Pat. No. 7,740,046, issued Jun. 22, 2010; U.S. patent application Ser. No. 13/149,520, filed May 31, 2011; pending and U.S. patent application Ser. No. 13/324,849, filed Dec. 13, 2011, pending.

TECHNICAL FIELD

The present invention relates to movable partitions and, more particularly, to systems, apparatuses and methods for preventing lateral displacement of one or more portions of such partitions.

BACKGROUND

Movable partitions are utilized in numerous situations and environments for a variety of purposes. Such partitions may include, for example, foldable or collapsible doors configured to close off an opening in order to enclose a room or to subdivide a single large room into one or more smaller rooms. The subdivision of a larger area may be desired, for example, to accommodate the simultaneous meeting of multiple groups. In such applications movable partitions are useful, among other things, for providing privacy and noise reduction.

Movable partitions may also be used to act as a security barrier, a fire barrier or as both. In such a case, the movable partition may be configured to automatically close upon the occurrence of a predetermined event such as the actuation of an associated alarm. For example, one or more movable partitions may be configured as a fire door or barrier wherein each door is formed with a plurality of panels connected to each other by way of hinge mechanisms. The hinged connection of the panels allows the door to fold-up in a compact unit on one side of the opening or it may be stored in a pocket formed within a wall and being designed to conceal the door and preserve the aesthetics of the room where the door is installed. When deployment of the door is necessary, the door is driven by a motor along a track (the track often being incorporated into the header above the door), until the leading edge of the door, often defined by a component called a lead post, complementarily engages a mating receptacle. Such a mating receptacle may be referred to as a jamb or a door post when formed in a fixed structure (such as a wall), or as mating lead post when formed in another door or movable partition. The lead post, when properly engaged with the door jamb (or the mating lead post), allows corresponding latching mechanisms to engage if desired, and helps to provide a desired seal (e.g., a seal with respect to airflow, sound waves or both).

However, even when a movable partition is properly closed, the door seal may be broken, for example, if the lower edge of the door is laterally displaced relative to the top edge of the door. Such lateral displacement of the lower edge of the door can be caused, for example, by a draft created by a fire, an improperly balanced HVAC system, or simply by a person pushing on the door. When the seal is broken, smoke and flames may intrude around the door if the door is being used as a fire barrier. If the door is being used in a security installation, a person may sufficiently displace the door to enable that person, or another, to slide or crawl underneath the door. At a minimum, displacement of the base of the door is unsightly and significantly reduces the door's effectiveness as a privacy screen and noise barrier.

One approach to preventing or controlling the lateral displacement of a door, including the door's lower edge, is to engage the lower edge of the door in a guide track that is either embedded in or otherwise attached to the floor. However, the use of a track can present various issues. For example, a track disposed in the floor can pose a safety issue, regardless of whether it protrudes above the floor or is recessed within the floor, potentially resulting in a person twisting an ankle or tripping and falling. Likewise, such a track may act as a significant obstacle for wheeled conveyances. Additionally, such a guide track, being exposed when the associated door is in a retracted state, is prone to damage and may act as a collection point for dirt and debris.

Some efforts have been made to prevent the lateral displacement of the lower edge of such a movable partition to prevent fluid flow beneath the movable partition without the use of a track in the floor. For example, U.S. patent application Ser. No. 11/796,325, now U.S. Pat. No. 7,740,046, issued Jun. 22, 2010, entitled METHOD, APPARATUS AND SYSTEM FOR CONTROLLING A MOVABLE PARTITION; U.S. patent application Ser. No. 11/934,566, now U.S. Pat. No. 7,931,067, issued Apr. 26, 2011, entitled MOVABLE PARTITIONS WITH LATERAL RESTRAINT DEVICES AND RELATED METHODS; and U.S. patent application Ser. No. 11/652,446, now U.S. Pat. No. 7,926,538, issued Apr. 19, 2011, entitled LATERAL RESTRAINT FOR A MOVABLE PARTITION, MOVABLE PARTITIONS INCORPORATING SAME AND RELATED METHODS (the disclosures of each of which are hereby incorporated by reference in their entireties) discuss various means of reducing or preventing the lateral displacement of the lower edge of a movable partition.

Nevertheless, it is a desire within the industry to continually improve the operation of movable partitions. As such, apparatuses and systems are provided herein to substantially secure a movable partition from lateral displacement. In certain embodiments, methods, apparatuses and systems are provided that substantially maintain the lateral position of a lower edge of a movable partition in order to maintain a seal formed by the partition without the need to employ a track or other structure disposed within a floor over which the partition traverses.

BRIEF SUMMARY OF THE INVENTION

Embodiments of the present invention include movable partitions and devices, methods and systems that help to limit or prevent lateral displacement of movable partitions. In accordance with one embodiment of the present invention, a movable partition is provided that includes a first structure having a first plurality of panels, each panel being hingedly coupled to an adjacent panel, the first structure being supported from an overhead track at a first location. The movable partition further includes a second structure having a second plurality of panels, each panel being hingedly coupled to an adjacent panel, the second structure being supported from the overhead track from a second location, the second location being laterally spaced from the first location. At least one lateral restraint device is supported from the overhead track at a location between the first location and the second location. The at least one lateral restraint device includes a trolley disposed in a channel of the overhead track and an elongated member coupled with the trolley and extending away from the trolley to a location proximate a lower edge of the first structure and a lower edge of the second structure.

In accordance with another embodiment of the present invention, a method of restraining lateral movement of a movable partition is provided. The method includes suspending a first structure from a support structure, wherein the first structure includes a first plurality of panels wherein each panel is hingedly coupled to an adjacent panel. A second structure is also supported from the support structure at a laterally spaced location relative to the first structure, the second structure including a second plurality of hingedly coupled panels. At least one elongated member is supported from the support structure along an axis extending away from the support structure and between the first structure and the second structure. The elongated member is substantially restrained from being laterally displaced toward either the first structure or the second structure.

In accordance with yet another embodiment, a device for preventing lateral displacement of one or more structures in a movable partition is provided. The device includes a trolley and an elongated member coupled with and extending from the trolley. The trolley includes a structural member and a first plurality of roller elements coupled with the structural member on a first side thereof. At least two roller elements of the first plurality have rotational axes lying in a first plane and at least one roller element of the first plurality has a rotational axis lying outside of the first plane. A second plurality of roller elements is coupled with the structural member on a second side thereof. At least two roller elements of the second plurality having rotational axes lying in the first plane and at least one roller element of the second plurality has a rotational axis lying outside of the first plane. The trolley further includes a third plurality of roller elements coupled with the structural member. The rotational axes of each of the third plurality of roller elements are angularly displaced relative to the rotational axes of each of the first plurality of roller elements.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
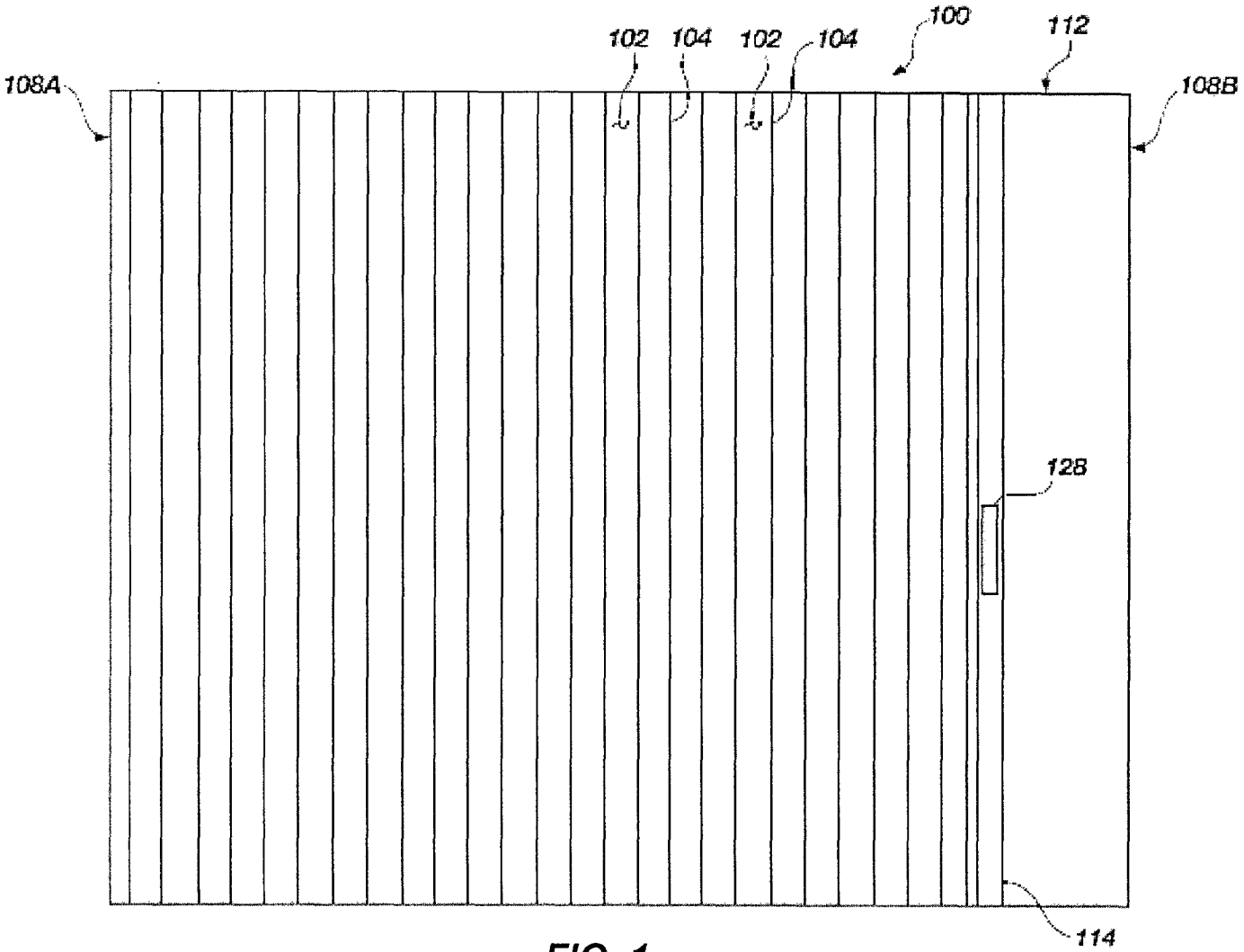
FIG. 1 is an elevation view of a movable partition in accordance with one embodiment of the present invention.
Figure 2:
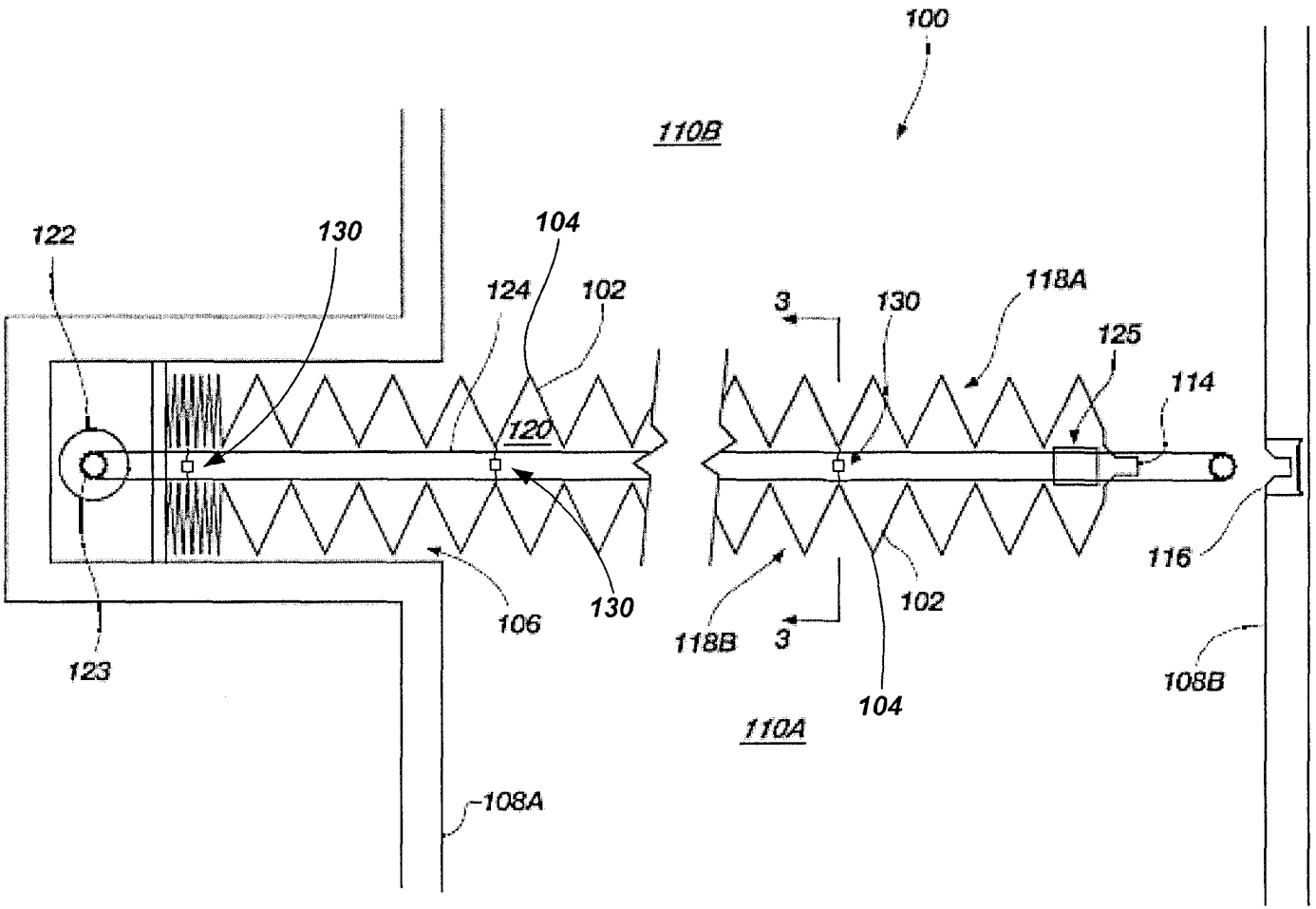
FIG. 2 is a plan view of the movable partition shown in FIG. 1.

Referring to FIGS. 1 and 2, an elevation view and a plan view are shown, respectively, of a movable partition 100. In the example shown in FIGS. 1 and 2, the partition 100 may be in the form of folding door. In certain embodiments, the partition 100 may be used, for example, as a security door, a fire barrier or as both. In other embodiments, the partition need not be utilized as a fire or security barrier, but may be used, for example, to subdivide a larger space into smaller rooms or areas or it may be used as a sound barrier.

The partition 100 may be formed with a plurality of panels 102 that are connected to one another with hinges 104 or other hinge-like structures in an alternating pattern of panel 102 and hinge 104. The hinged connection of the individual panels 102 enables the panels to fold relative to each other in an accordion or a plicated manner such that the partition 100 may be compactly stored, such as in a pocket 106 formed in a wall 108A of a building when the partition is in a retracted or folded state.

When in a deployed state, the partition 100 may extend from one wall 108A to a second wall 108B to act as a barrier (e.g., a fire or security barrier) or to divide one area or room into multiple rooms 110A and 110B. When it is desired to deploy the partition 100 from a stowed condition to an extended position, for example, to secure an area during a fire, the partition 100 may be motivated along an overhead track 112 across the space to provide an appropriate barrier. When in a deployed or an extended state, a leading edge of the partition 100, shown as a male lead post 114, may complementarily or matingly engage with a jamb or door post 116 that may, for example, be formed in a wall 108B of a building.

As best seen in FIG. 2, the partition 100 may include a first barrier or structure 118A and a second barrier or structure 118B, each including a plurality of panels 102 coupled with one another by way of hinges 104 or hinge-like structures. The second structure 118B is laterally spaced from the first structure 118A. Such a configuration may be utilized, for example, as a fire door wherein one structure (e.g., structure 118A) acts as a primary fire and smoke barrier, a space 120 between the two structures 118A and 118B acts as an insulator or a buffer zone, and the other structure (e.g., structure 118B) acts as a secondary fire and smoke barrier. Such a configuration may also be useful in providing an acoustical barrier when the partition is used to subdivide a larger space into multiple, smaller rooms.

It is noted that the structures 118A and 118B are each individually suspended from the overhead track 112. In other words, the track 112 may have multiple elongated channels formed therein such that one structure 118A is suspended from, and longitudinally displaced along, a first channel while the second structure 118B is suspended from, and longitudinally displaced along, a second, separate channel. Such an embodiment is shown and described in further detail below. In another embodiment, multiple individual tracks may be located in or on the ceiling or other supporting structure.

Various means may be used to displace the partition 100 from a stowed condition to a deployed condition and vice versa. For example, depending on the intended use of the partition 100, it may be displaced manually (i.e., by an individual pushing or pulling it along the track 112). In another embodiment, an appropriate actuator may be used to displace the partition 100.

For example, a drive may be used to motivate the partition 100 between a deployed and a retracted state or vice versa. In one embodiment, such a drive may include an electric motor 122 coupled to a pulley or gear 123 configured to drive a transmission member such as a belt or chain 124. A portion of the belt or chain 124 may be coupled to a trolley 125 that is configured to ride along the track 112. The trolley 125 may be coupled to a component of the partition 100 such as, for example, the lead post 114. Thus, actuation of the motor 122 and belt or chain 124 in a first direction results in displacement of the trolley 125 and lead post 114 so that the partition 100 may be deployed. Actuation of the motor 122 and belt or chain 124 in a second direction results in displacement of the trolley 125 and lead post 114 so that the partition 100 may be retracted.

Additionally, while not specifically shown, various sensors and switches may be employed in association with such a drive to assist in the control of the partition 100. For example, as shown in FIG. 1, the partition 100 may include a switch or actuator 128, sometimes referred to as "panic hardware." Actuation of the panic hardware 128 enables a person located on one side of the partition 100 (e.g., in room 110A) to cause the partition 100 to open if it is closed, or to stop while it is closing, so as to provide access through the barrier formed by the partition 100 for a predetermined amount of time.

It is noted that, while the above description has been directed more specifically to an embodiment including a single partition 100 extending from one wall 108A to another wall 108B, other configurations of movable partitions may be utilized. For example, a two-door, or bi-part partition configuration may be utilized wherein two similarly configured partitions extend across a space and join together to form an appropriate barrier as will be appreciated by those of ordinary skill in the art. In other embodiments, a multi-part configuration may be employed wherein multiple partitions join at a central door post when each is in an extended state.

While the upper portion of the structures 118A and 118B are substantially restrained from lateral displacement due to their slidable coupling with the track 112 (or tracks), the lower edges of the partitions 100, if not properly restrained, may be laterally displaced such that a substantial gap may be formed between the lower edges of the structures 118A and 118B and the floor or other surface over which they pass. As previously discussed, such displacement may occur due to, for example, a draft from a fire, an imbalanced HVAC (heating, ventilation and air conditioning) system, or from some other external force being applied to one of the structures 118A and 118B. To prevent, or at least minimize such lateral displacement, one or more lateral restraint devices 130 may be associated with the movable partition 100.

Referring to FIGS. 3 through 6, with continued reference to FIGS. 1 and 2, a lateral restraint device 130 is shown and described in greater detail. The lateral restraint device 130 may include a trolley 140 (separate and distinct from the trolley 125 described above) having rollers 142 or sliders coupled with a structural member 143. The rollers 142 may be disposed in a central channel 144 of the track 112 and configured to roll or slide along the length of the channel 144. A bar or other elongated member 146 is coupled with the trolley 140 and extends downwardly from the trolley 140 through an opening 148 in the lower portion of the track 112 such that the elongated member 146 is positioned between the two laterally spaced barriers or structures 118A and 118B.

As previously discussed, each of the laterally spaced structures 118A and 118B include hingedly connected panels 102 that are supported from channels 150 and 152 of the overhead track 112 by, for example, associated rollers 154 or sliding elements. The elongated member 146 may be coupled with a panel 102 or a hinge 104 of either, or both, of the structures 118A and 118B by an appropriate coupling member. For example, in one embodiment, a chain 156 (or a cable, rope or similar component) may be coupled between the elongated member 146 and a hinge 104 or panel 102 of either or both of the structures 118A and 118B. In another embodiment, a substantially rigid bracket 158 (shown in dashed lines) may be coupled between the elongated member 146 and a hinge 104 or panel 102 of either or both of the structures 118A and 118B. In one particular embodiment, such a bracket 158 may include, or be similar to the brackets used in conjunction with the lateral restraint device described in U.S. patent application Ser. No. 11/934,566, now U.S. Pat. No. 7,931,067, issued Apr. 26, 2011, entitled MOVABLE PARTITIONS WITH LATERAL RESTRAINT DEVICES AND RELATED METHODS, previously incorporated by reference.

The coupling of the elongated member 146 with one or both of the barriers or structures 118A and 118B provides a motivating force to displace the lateral resistance device 130 during opening of closing of the partition 100 such that the lateral restraint device 130 remains proximate associated panels 102 and/or hinges 104 of the structures 118A and 118B. In other words, during displacement of the partition 100 (i.e., during extension or retraction thereof), as the panel 102 or hinge 104 to which the elongated member 146 is coupled is displaced, the elongated member 146 will likewise be displaced along the track 112.

As may be seen in FIGS. 3 through 6, the trolley 140 includes multiple roller elements 142 on opposing sides of the trolley 140. More specifically, the trolley 140 is positioned generally along a centerline 160 of the partition 100 such that a plurality of roller elements 142 are disposed on one side of the centerline 160 and a plurality of roller elements 142 are disposed on the opposite side of the centerline 160. In the embodiment shown in FIGS. 3-6, there are four roller elements 142 disposed on each side of the trolley 140. However, in other embodiments, a different number of roller elements 142 may be utilized.

Figure 6:
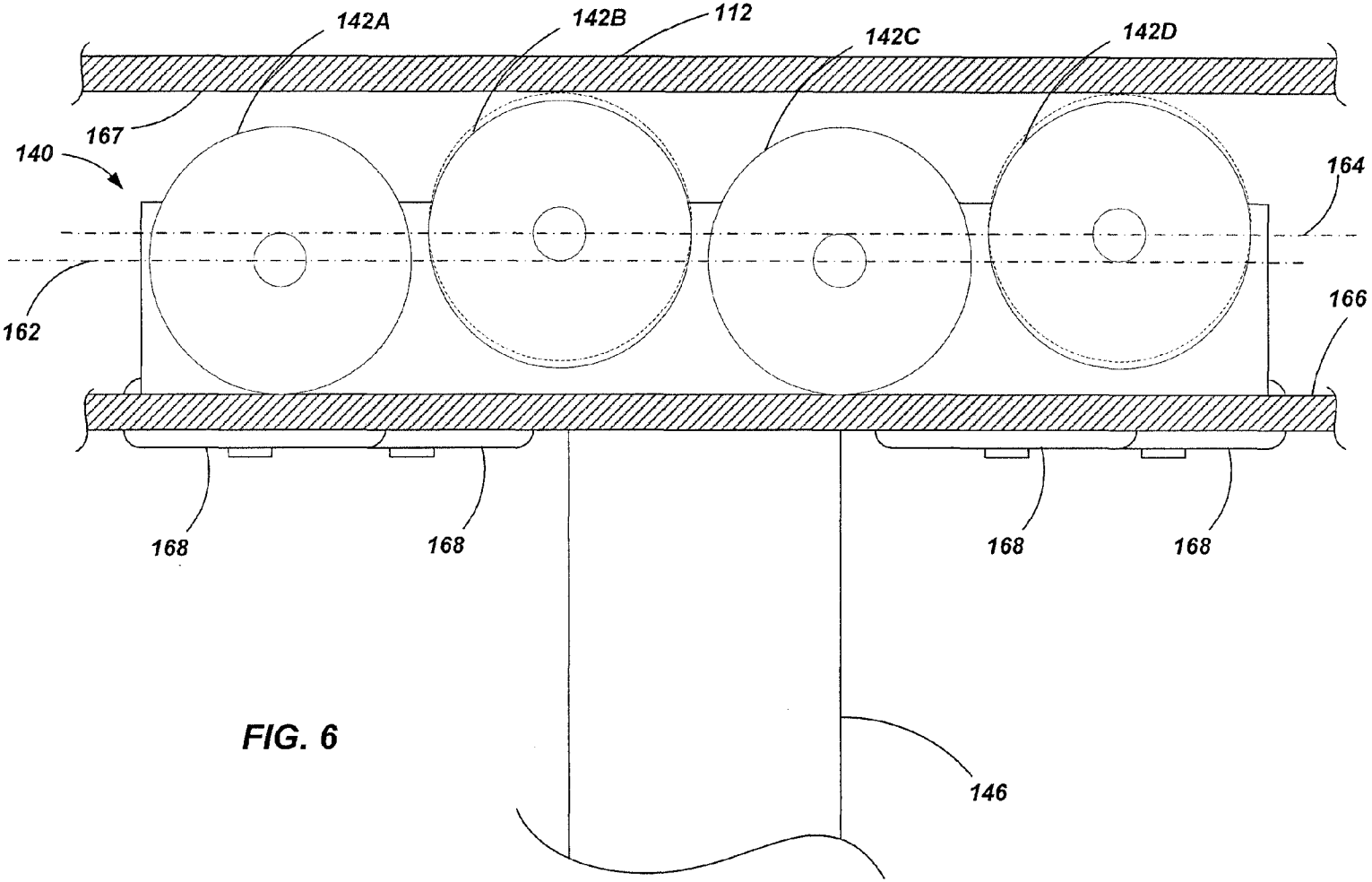
FIG. 6 is a partial cross-sectional view taken along section lines 6-6 in FIG. 3.

As perhaps best seen in FIG. 6, some of the roller elements 142 on a given side of the trolley 140 are offset relative to the other roller elements 142. For example, roller elements 142A and 142C have rotational centers or axes lying within a first common plane (represented by axis 162) while roller elements 142B and 142D have rotational centers or axes lying along a second plane (represented by axis 164) that is offset (vertically offset in the orientation shown in FIG. 6) relative to the first axis 162. The roller elements 142 on the opposing side of the trolley 140 may be configured in a similar matter such that, for example, various roller elements 142 have rotational axes that lie in the first plane 162 and other roller elements 142 have rotational axes that lie in the second plane 164.

It is noted that, in such a configuration, two of the roller elements (i.e., 142A and 142C) are in contact with, and ride along, a lower, inside surface 166 of the central channel 144. The use of multiple roller elements that are in contact with the lower, inside surface 166 of the central channel 144 helps to stabilize the lateral restrain device 130 from pivoting at or near the point of the trolley 140. In other words, if only a single roller element were to maintain contact with the lower, inside surface 166, the lower portion of the elongated member could be easily angularly displaced in a direction along the path of the partition (i.e., to the right or the left as viewed in FIG. 6).

Additionally, it is noted that in the embodiment shown in FIGS. 3 through 6, two of the roller elements (i.e., 142B and 142D) do not contact the lower, inside surface 166, but rather, are within a specified tolerance of, or even contact, an upper inside surface 167 of the central channel 144 (as indicated by dashed lines). This helps to prevent, or at least limit, potential angular displacement of the elongated member 146 in a direction substantially orthogonal to the path of the partition 100 (i.e., to the right or left as viewed in FIG. 3).

Figure 3:
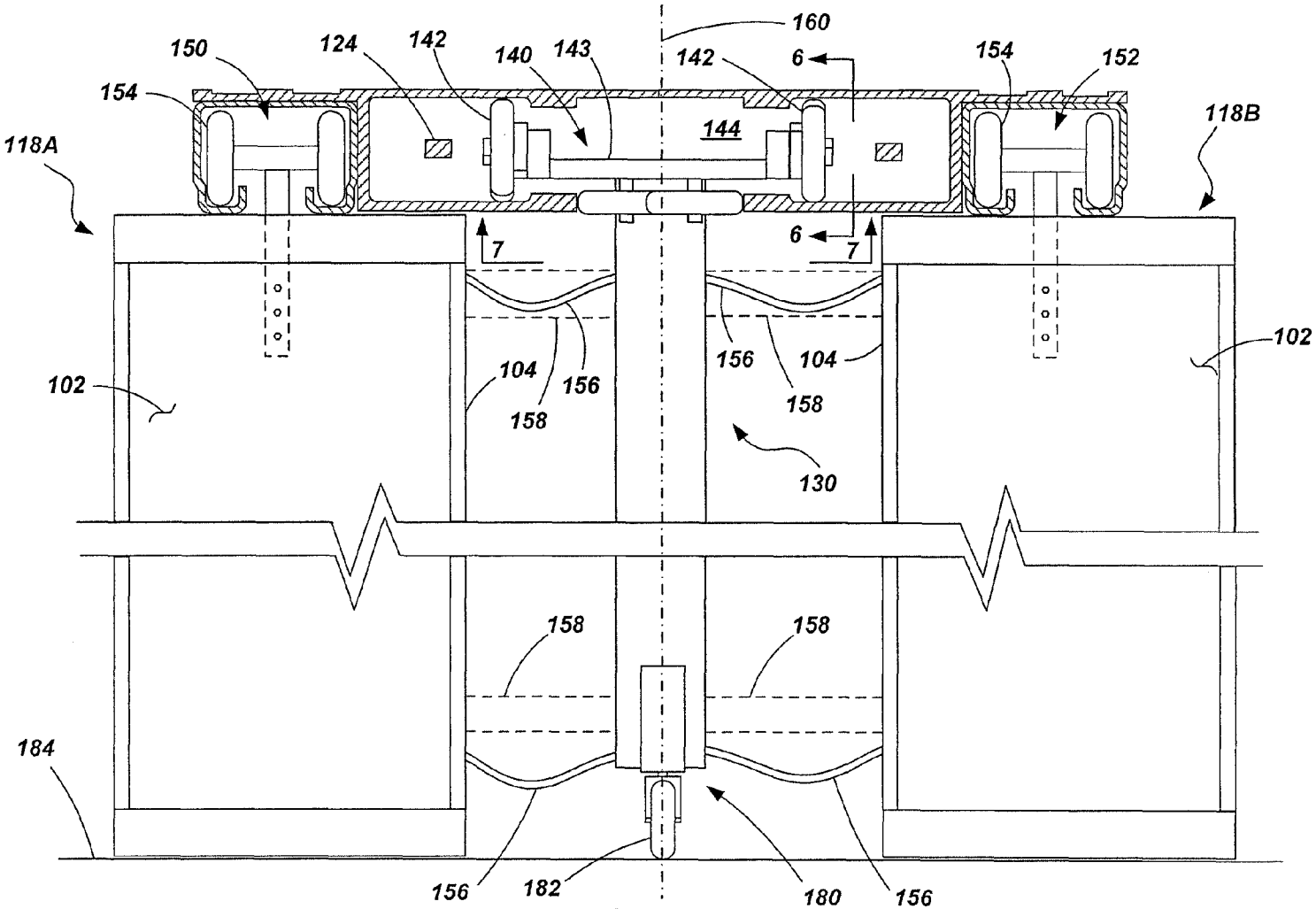
FIG. 3 is a partial cross-sectional view of a partition including an overhead track and a lateral restraint device taken along section lines 3-3 and in accordance with an embodiment of the present invention.
Figure 4:
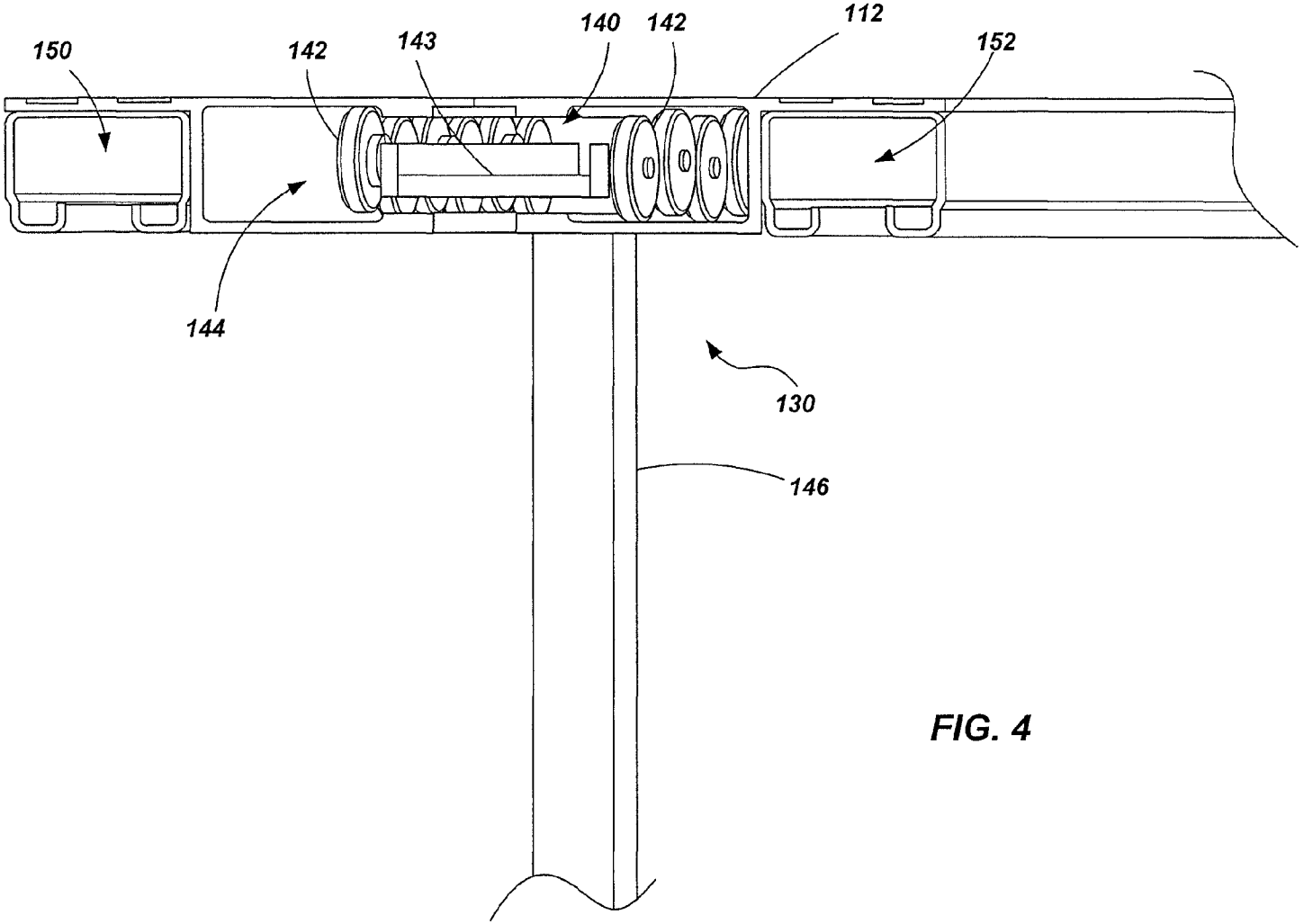
FIG. 4 is a perspective view of the overhead track and lateral restraint device shown in FIG. 3.
Figure 5:
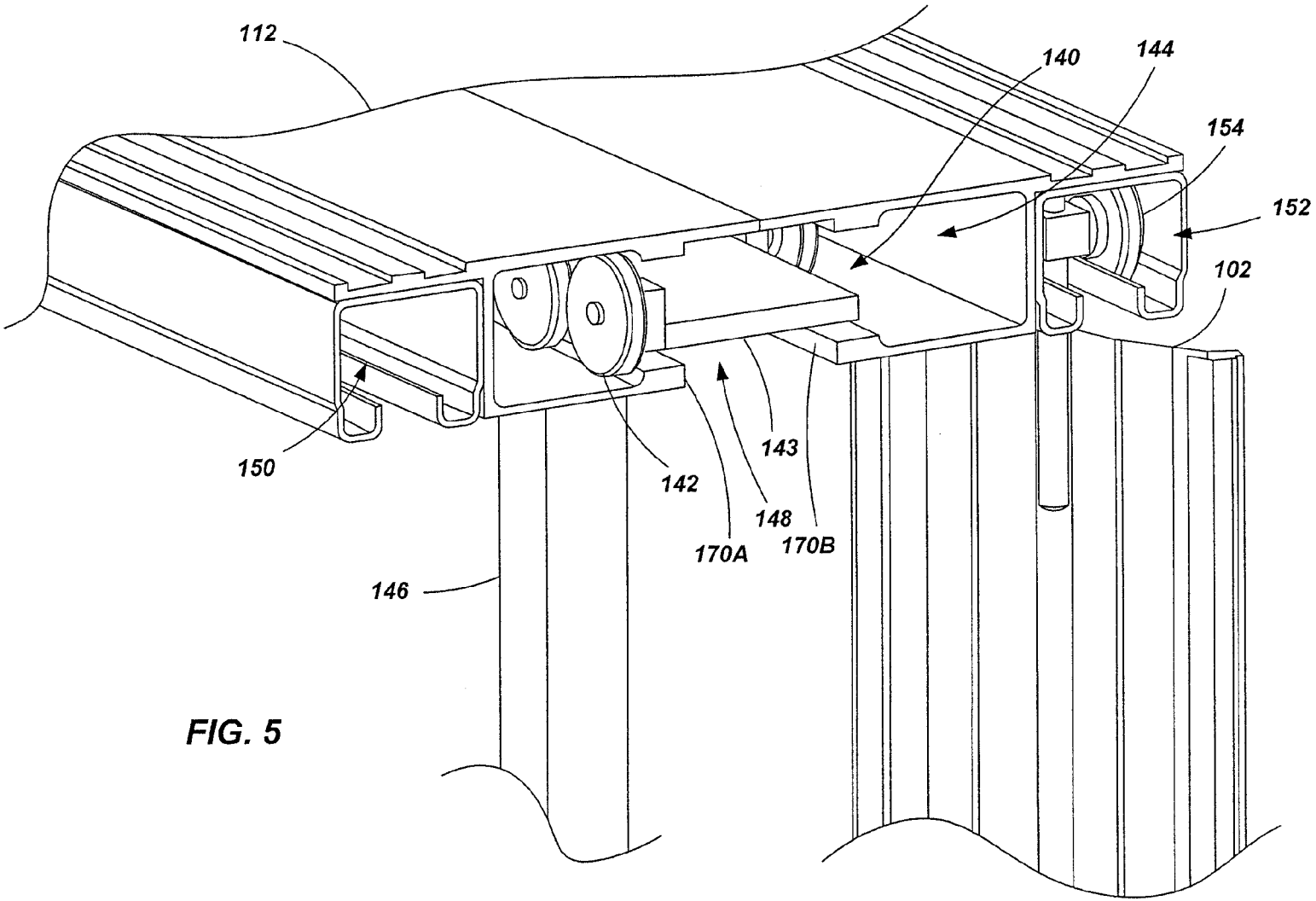
FIG. 5 is another perspective view of the overhead track and lateral restraint device shown in FIG. 3.
Figure 7:
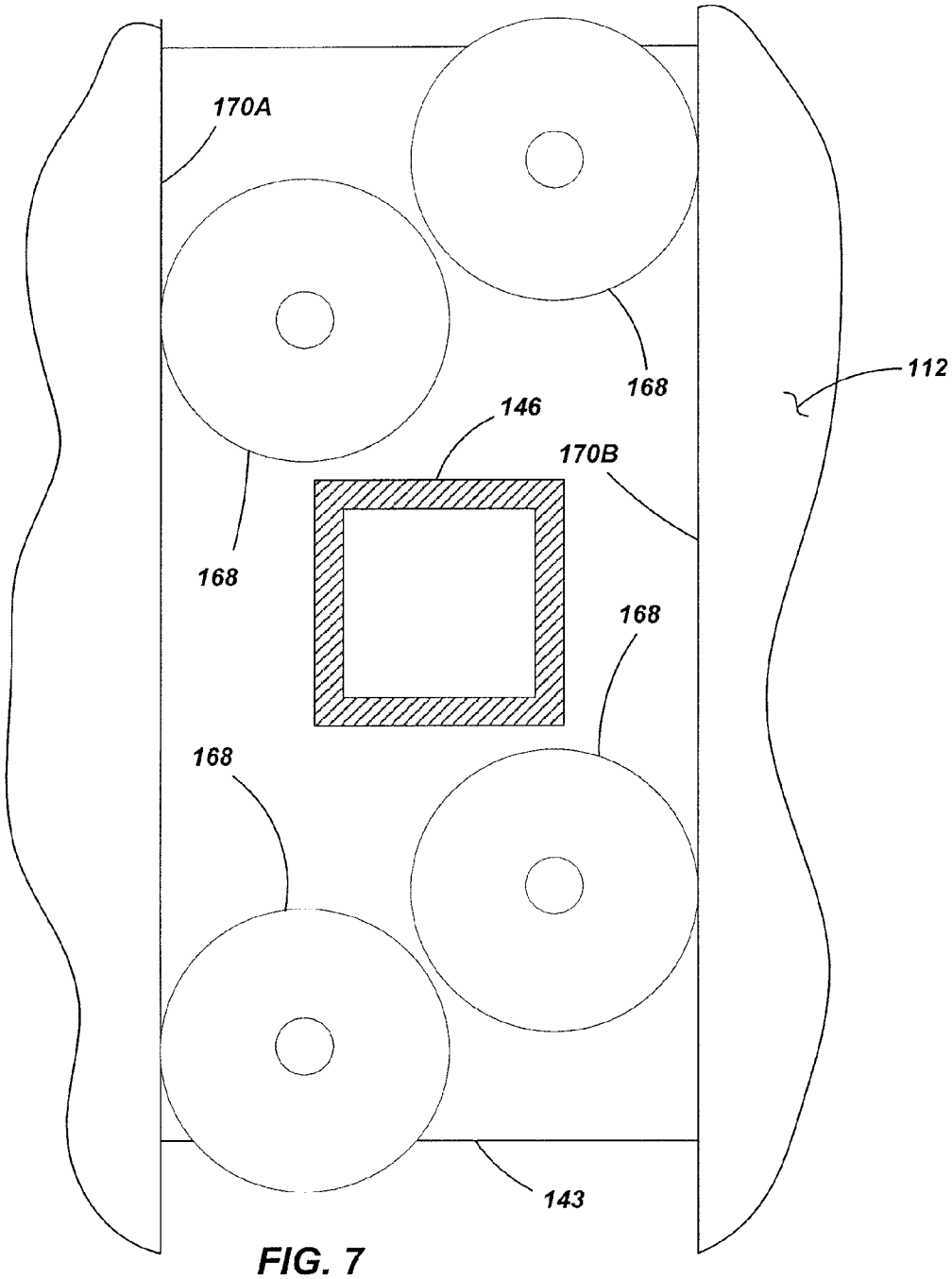
FIG. 7 is a detail view of certain components of a lateral restraint device as indicated by section lines 7-7 in FIG. 3.

Additionally, as seen best in FIGS. 3 and 7, additional roller elements 168 or sliding elements may be coupled, for example, to a bottom portion of the structural member 143. In the embodiment shown, the additional roller elements 168 are orientated to lie in a plane that is substantially orthogonal to the other roller elements 142 coupled to the trolley 140. Of course, those of ordinary skill in the art will appreciate that the various roller elements 142 and 168 may be angled, canted or exhibit other orientations and still provide the desired functionality as is described with respect to the currently contemplated embodiment.

The additional roller elements 168 are configured to abut and roll against opposing edge surfaces 170A and 170B of the central opening 148. One advantage of using the additional rollers 168 is that they help avoid angular displacement of the elongated member 146 in a direction substantially orthogonal to the path of the partition 100 (i.e., to the right or left as viewed in FIG. 3). In different embodiments, the additional rollers 168 may be used in addition to, or in place of, the upper roller elements (i.e., 142B and 142D) to help prevent or limit the angular displacement of the elongated member 146. However, the use of the additional roller elements 168 also helps to prevent the trolley 140 and associated roller elements 142 from being twisted (e.g., about an axis extending substantially through the height—as viewed in the drawings—of the elongated member 146) and helps prevent the trolley 140 from becoming bound within the central channel 144 of the track 112.

Thus, the lateral displacement device 130 provides a structural member (e.g., elongated member 146) positioned between the two laterally spaced structures 118A and 118B and which, while displaceable along the track 112, is substantially laterally constrained. In an embodiment where, for example, a chain 156 is used to coupled a structure (e.g., 118A) with the elongated member 146, when a force is applied to a structure (e.g., 118A), the structure will become displaced until it contacts the elongated member 146. The elongated member 146 will then resist further displacement due to its coupling with the trolley 140, the trolley 140 being configured to prevent or limit angular displacement of the elongated member 146 as described hereinabove. It is noted that while the barriers or structures 118A and 118B may be laterally displaced in such an embodiment until they contact the elongated member 146, such displacement is minimal (e.g., a few inches) and does not substantially effect the ability of the partition 100 to perform its intended function as a barrier.

In an embodiment where, for example, a bracket 158 or substantially rigid coupling is formed between a structure (e.g., 118A) and the elongated member 146, when a lateral force is applied to the structure (e.g., 118A), the force will be transmitted through the bracket 158 to the elongated member 146, which will resist the force and limit displacement of the structure (e.g., 118A).

It is noted that the lateral restraint device 130 prevents lateral displacement of the barriers or structures 118A and 118B primarily at the locations where the lateral restraint device 130 is installed. In other words, at a longitudinal distance (i.e., along the pathway of the partition 100) from the lateral restraint device 130, a barrier or structure 118A or 118B will likely experience some lateral displacement. Thus, to limit lateral displacement of the barriers or structures 118A and 118B along their entire lengths (when in an extended state), multiple lateral restraint devices 130 may be installed at desired frequencies or distances from one another (depending, for example, on the extended length of the partition 100) as indicated in FIG. 2. In other words, when using multiple lateral displacement devices 130, the point of maximum potential lateral displacement of a barrier or structure 118A or 118B will be at a midpoint between two adjacent lateral restraint devices 130. By determining the maximum allowable lateral displacement of any portion of the partition, one can design a partition with an appropriate number of longitudinally spaced lateral restraint devices 130.

In another embodiment, the lateral restraint devices 130 may be incorporated with a system such as is described in Ser. No. 11/652,446, now U.S. Pat. No. 7,926,538, issued Apr. 19, 2011, entitled LATERAL RESTRAINT FOR A MOVABLE PARTITION, MOVABLE PARTITIONS INCORPORATING SAME AND RELATED METHODS. In such a case, a cable or other member may be disposed between the two barriers or structures 118A and 118B at a location proximate the bottom edges thereof and extend the length of the partition 100 when in a deployed or extended state. In such an embodiment, such a cable may be slidably coupled to (or, in another embodiment, positioned adjacent to) the elongated members 146 effectively providing a collapsible framework within the partition 100 between the laterally spaced barriers or structures 118A and 118B.

Referring back to FIG. 3, the lateral restrain device 130 may also include a roller assembly 180 coupled to a lower end of the elongated structure 146. For example, the roller assembly 180 may include a wheel or other roller element 182 configured to contact and roll along a floor 184 or other surface over which the partition 100 is disposed. The roller assembly 180 may additionally include components that help the roller element 182 to maintain contact with the floor 184 as it rolls there across even though the floor 184 may exhibit undulations or elevation changes. For example, the roller assembly 180 may include a constant force mechanism such as that which is described in U.S. patent application Ser. No. 11/796,325, now U.S. Pat. No. 7,740,046, issued Jun. 22, 2010, entitled METHOD, APPARATUS AND SYSTEM FOR CONTROLLING A MOVABLE PARTITION and which has been previously incorporated by reference. Such a constant force mechanism may utilize linear actuators and sensors to maintain a desired force between the roller element 182 and the floor 184, even when the elevation of the floor 184 deviates substantially along the pathway of the partition 100. In another embodiment, such a constant force mechanism may include a biasing member, such as a spring, to continually bias the roller element 182 against the floor 184 with a substantially constant force.

Maintaining contact between the floor 184 and the roller element 182 provides additional support to the elongated member 146 to keep it from being laterally displaced. In other words, by application of a desired force between the roller element 182 and the floor 184, the elongated member 146 essentially becomes "wedged" between the floor 184 and the overhead track 112 and will resist lateral displacement.

In some embodiments, the roller assembly 180 may include a caster or similar mechanism that enables the roller element 182 to pivot or swivel relative to the elongated member 146 such that the roller element 182 may change directions concurrently with a change in direction of the partition 100 (e.g., from extension to retraction) without binding. Additionally, in some embodiments, the roller assembly 182 may include a directional control mechanism such as is described in the aforementioned U.S. patent application Ser. No. 11/796,325. The directional control mechanism may be used, for example, to further help maintain the elongated member 146 (and the section of partition 100, with which it is associated) in a substantially plumb orientation, again preventing or limiting the lateral displacement of the door.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition comprising:

at least one structure supported from a first portion of an overhead track and having a plurality of panels, each panel being hingedly coupled to an adjacent panel; and at least one lateral restraint device positioned at a location directly laterally adjacent the at least one structure and remote from a leading end of the movable partition, the at least one lateral restraint device including a trolley disposed in and supported separately from the at least one structure by a second portion of the overhead track separate and laterally spaced from the first portion of the overhead track and an elongated member coupled with the trolley, the elongated member coupled to the least one structure and extending away from the trolley to a location proximate a lower edge of the at least one structure.

2. The movable partition of claim 1, wherein the at least one lateral restraint device is positioned at the location directly laterally adjacent the at least one structure in a direction transverse to a direction of movement of the at least one structure along the overhead track.

3. The movable partition of claim 1, further comprising a roller assembly coupled with the elongated member at the location proximate the lower edge of the at least one structure.

4. The movable partition of claim 3, wherein the roller assembly is configured to contact a surface over which the movable partition is disposed to resist lateral displacement of the movable partition.

5. The movable partition of claim 4, wherein the roller assembly is configured to resist lateral displacement of the movable partition by creating a wedge between the movable partition and the surface over which the movable partition is disposed.

6. The movable partition of claim 4, wherein the at least one lateral restraint device is configured to bias the roller assembly into contact with the surface over which the movable partition is disposed.

7. The movable partition of claim 6, wherein the roller assembly comprises a spring for biasing the roller assembly into contact with the surface over which the movable partition is disposed.

8. The movable partition of claim 3, wherein the roller assembly comprises a caster configured to swivel relative to the elongated member.

9. The movable partition of claim 1, wherein the at least one lateral restraint device is coupled to a hinge coupling two panels of the plurality of panels of the at least one structure together.

10. The movable partition of claim 1, wherein the first portion of the overhead track comprises a first channel, and wherein the second portion of the overhead track comprises a second channel.

11. The movable partition of claim 1, wherein a portion of the at least one lateral restraint device is configured to contact a surface over which the movable partition is disposed and resist lateral displacement of the movable partition.

12. The movable partition of claim 11, wherein the portion of the at least one lateral restraint device is configured to resist lateral displacement of the movable partition by creating a wedge between the movable partition and the surface over which the movable partition is disposed.

13. The movable partition of claim 1, wherein the at least one structure further comprises a second structure having a second plurality of panels, each panel being hingedly coupled to an adjacent panel, the second structure being individually supported from the overhead track separate from the at least one restraint member and the plurality of panels, the second plurality of panels being laterally spaced from the plurality of panels in a direction perpendicular to an intended direction of travel of the at least one structure and the second structure along the overhead track.

14. The movable partition of claim 13, wherein the at least one lateral restraint device is coupled only to one of the at least one structure and the second structure.

15. The movable partition of claim 13, wherein the at least one lateral restraint device is coupled to both the at least one structure and the second structure.

16. The movable partition of claim 1, wherein the at least one lateral restraint device comprises a plurality of lateral restraint devices spaced along a length of the movable partition, each lateral restraint device of the plurality of lateral restraint devices comprising:

a respective trolley comprising a plurality of roller elements and disposed in the first portion of the overhead track; and a respective elongated member coupled with and extending from the respective trolley, the respective elongated member positioned at a location adjacent the at least one structure remote from the leading end of the movable partition.

17. A method of installing a movable partition, the method comprising:

suspending a structure from a first channel of an overhead track, the structure including a first plurality of panels wherein each panel is hingedly coupled to an adjacent panel;

suspending at least one elongated member separately from and directly laterally adjacent to the structure in a second channel of the overhead track laterally spaced from the first channel and remote from a leading end of the structure;

coupling the at least one elongated member to the structure;

coupling a roller assembly including at least one roller element to the at least one elongated member; and engaging a surface underlying the movable partition with the at least one roller element.

18. The method of claim 17, further comprising biasing the at least one roller element into contact with the surface underlying the movable partition.

* * * * *